US011322896B2

(12) United States Patent
Wang et al.

(10) Patent No.: US 11,322,896 B2
(45) Date of Patent: May 3, 2022

(54) ELECTRICAL CONNECTOR

(71) Applicant: DONGGUAN LEADER PRECISION INDUSTRY CO., LTD, Dongguan (CN)

(72) Inventors: Yong Wang, Dongguan (CN); Li-Jun Xu, Dongguan (CN); Hong-Qiang Xu, Dongguan (CN); Meng-Jie Peng, Dongguan (CN)

(73) Assignee: DONGGUAN LEADER PRECISION INDUSTRY CO., LTD, Dongguan (CN)

( * ) Notice: Subject to any disclaimer, the term of this patent is extended or adjusted under 35 U.S.C. 154(b) by 0 days.

(21) Appl. No.: 17/100,321

(22) Filed: Nov. 20, 2020

(65) Prior Publication Data

US 2021/0075165 A1 Mar. 11, 2021

(30) Foreign Application Priority Data

Dec. 2, 2019 (CN) ..... 201922139211.4

(51) Int. Cl.
*H01R 13/6585* (2011.01)
*H01R 12/72* (2011.01)
(Continued)

(52) U.S. Cl.
CPC ..... *H01R 13/6585* (2013.01); *H01R 12/727* (2013.01); *H01R 13/50* (2013.01);
(Continued)

(58) Field of Classification Search
CPC .. H01R 13/6585; H01R 12/727; H01R 13/50; H01R 13/659; H01R 13/6594;
(Continued)

(56) References Cited

U.S. PATENT DOCUMENTS

2015/0325955 A1* 11/2015 Chien ..... H01R 13/659
439/607.25

FOREIGN PATENT DOCUMENTS

CN 203351789 U 12/2013
CN 104319576 A * 1/2015
(Continued)

*Primary Examiner* — Abdullah A Riyami
*Assistant Examiner* — Justin M Kratt
(74) *Attorney, Agent, or Firm* — Birch, Stewart, Kolasch & Birch, LLP

(57) ABSTRACT

An electrical connector includes a first conductive terminal, a second conductive terminal, an insulated body integrally molded on the first conductive terminal and the second conductive terminal, and a metallic shell on the insulated body. The insulated body includes a first tongue portion and a second tongue portion aligned side by side. The first conductive terminal is provided with a first contact portion. The second conductive terminal is provided with a second contact portion. The metallic shell includes a first cylinder portion provided with a first space and a second cylinder portion provided with a second space. The first cylinder portion surrounding the first tongue portion and the second cylinder portion surrounding the second tongue portion share a dividing portion for separating the first space from the second space, so that the two electrical connection ports of the electrical connector are independent and avoid mutual influence between the two electrical connection ports.

10 Claims, 9 Drawing Sheets

(51) Int. Cl.

| | |
|---|---|
| ***H01R 13/50*** | (2006.01) |
| ***H01R 13/6594*** | (2011.01) |
| ***H01R 13/659*** | (2011.01) |
| *H01R 12/71* | (2011.01) |
| *H01R 13/6586* | (2011.01) |
| *H01R 107/00* | (2006.01) |
| *H01R 13/6581* | (2011.01) |
| *H01R 13/658* | (2011.01) |
| *H01R 13/405* | (2006.01) |
| *H01R 13/6596* | (2011.01) |
| *H01R 24/60* | (2011.01) |

(52) U.S. Cl.
CPC ..... *H01R 13/659* (2013.01); *H01R 13/6594* (2013.01); *H01R 12/712* (2013.01); *H01R 12/716* (2013.01); *H01R 13/405* (2013.01); *H01R 13/658* (2013.01); *H01R 13/6581* (2013.01); *H01R 13/6586* (2013.01); *H01R 13/6596* (2013.01); *H01R 24/60* (2013.01); *H01R 2107/00* (2013.01)

(58) Field of Classification Search
CPC .. H01R 12/712; H01R 12/716; H01R 13/658; H01R 13/6581; H01R 13/6586; H01R 2107/00; H01R 13/6596; H01R 24/60; H01R 13/405
See application file for complete search history.

(56) References Cited

FOREIGN PATENT DOCUMENTS

| | | | | | |
|---|---|---|---|---|---|
| CN | 104332771 | B | | 8/2016 | |
| CN | 104319576 | B | | 9/2016 | |
| CN | 109149215 | A | * | 1/2019 | ..... H01R 24/60 |
| JP | 3200315 | U | | 10/2015 | |
| JP | 2017-520091 | A | | 7/2017 | |
| JP | 2017-168423 | A | | 9/2017 | |

* cited by examiner

ELECTRICAL CONNECTOR

CROSS-REFERENCE TO RELATED APPLICATION

This non-provisional application claims priority under 35 U.S.C. § 119(a) to Patent Application No. 201922139211.4 filed in China, P.R.C. on Dec. 2, 2019, the entire contents of which are hereby incorporated by reference.

BACKGROUND

Technical Field

The instant disclosure relates to an electrical connector, and the instant disclosure belongs to the technical field of electronic components.

Related Art

A dual-row electrical connector known to the inventor(s) generally comprises two electrical connection ports. Each of the electrical connection ports comprises a tongue portion, a terminal on the tongue portion, and a metallic shell at least partially surrounding the tongue portion. In some configurations, the tongue portions of the two electrical connection ports are arranged separately. However, how to ensure that two tongue portions are at the same height when they are installed is a technical problem. Besides, in some configurations, a metallic shell is used to surround the two tongue portions as a whole. However, in this configuration, there is nothing between the two tongue portions to separate the two tongue portions completely. As a result, the tongue portions may be damaged easily when a mismatched electrical connector is inserted into the duel-row connector.

SUMMARY

A purpose of the instant disclosure is to provide an electrical connector with two independent electrical connection ports.

In view of this, an embodiment of the instant disclosure provides an electrical connector. The electrical connector comprises a first conductive terminal, a second conductive terminal, an insulated body integrally molded on the first conductive terminal and the second conductive terminal, and a metallic shell on the insulated body. The insulated body comprises a first tongue portion and a second tongue portion aligned side by side with the first tongue portion. The first conductive terminal is provided with a first contact portion exposed on the first tongue portion, and the second conductive terminal is provided with a second contact portion exposed on the second tongue portion. The metallic shell comprises a first cylinder portion surrounding the first tongue portion and a second cylinder portion surrounding the second tongue portion. The first cylinder portion is provided with a first space for receiving a first mating electrical connector, the second cylinder portion is provided with a second space for receiving a second mating electrical connector, and the first cylinder portion and the second cylinder portion share a dividing portion for separating the first space from the second space.

As a further improved technical solution of the instant disclosure, the first cylinder portion and the second cylinder portion are integrally formed as a one-piece member.

As a further improved technical solution of the instant disclosure, the first cylinder portion, the first tongue portion, and the first conductive terminal form a first electrical connection port. The second cylinder portion, the second tongue portion, and the second conductive terminal form a second electrical connection port. The first electrical connection port is identical to the second electrical connection port or the first electrical connection port is different from the second electrical connection port.

As a further improved technical solution of the instant disclosure, the first electrical connection port is identical to the second electrical connection port. The first contact portion is plate-shaped and comprises a first upper-row contact portion and a first lower-row contact portion. The second contact portion is plate-shaped and comprises a second upper-row contact portion and a second lower-row contact portion. A height of the first tongue portion is the same as a height of the second tongue portion.

As a further improved technical solution of the instant disclosure, both the first electrical connection port and the second electrical connection port have a specification of a type-C electrical receptacle connector interface.

As a further improved technical solution of the instant disclosure, the insulated body comprises a base portion. The first tongue portion and the second tongue portion integrally extend from the base portion. The electrical connector further comprises a first insulated block integrally formed with the first conductive terminal and a second insulated block integrally formed with the second conductive terminal, and the insulated body is molded on the first insulated block and the second insulated block.

As a further improved technical solution of the instant disclosure, the electrical connector further comprises a first shielding sheet fixed on the first insulated block and located between the first upper-row contact portion and the first lower-row contact portion and a second shielding sheet fixed on the second insulated block and located between the second upper-row contact portion and the second lower-row contact portion.

As a further improved technical solution of the instant disclosure, the first shielding sheet, the second shielding sheet, or each of the first shielding sheet and the second shielding sheet is provided with a mounting leg for mounting on a circuit board.

As a further improved technical solution of the instant disclosure, the electrical connector further comprises a metal grounding sheet connected to the metallic shell. The metal grounding sheet is provided with a grounding leg for mounting on a circuit board.

As a further improved technical solution of the instant disclosure, the metallic shell comprises a concave portion. The metal grounding sheet comprises a mounting portion mounted in the concave portion, and the mounting portion is fixed with the metallic shell through spot welding.

Compared with the prior art, in one or some embodiments of the instant disclosure, by the configuration of the dividing portion, the first space and the second space are separated. Therefore, the two electrical connection ports of the electrical connector are configured to be independent so as to avoid mutual influence between the two electrical connection ports.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
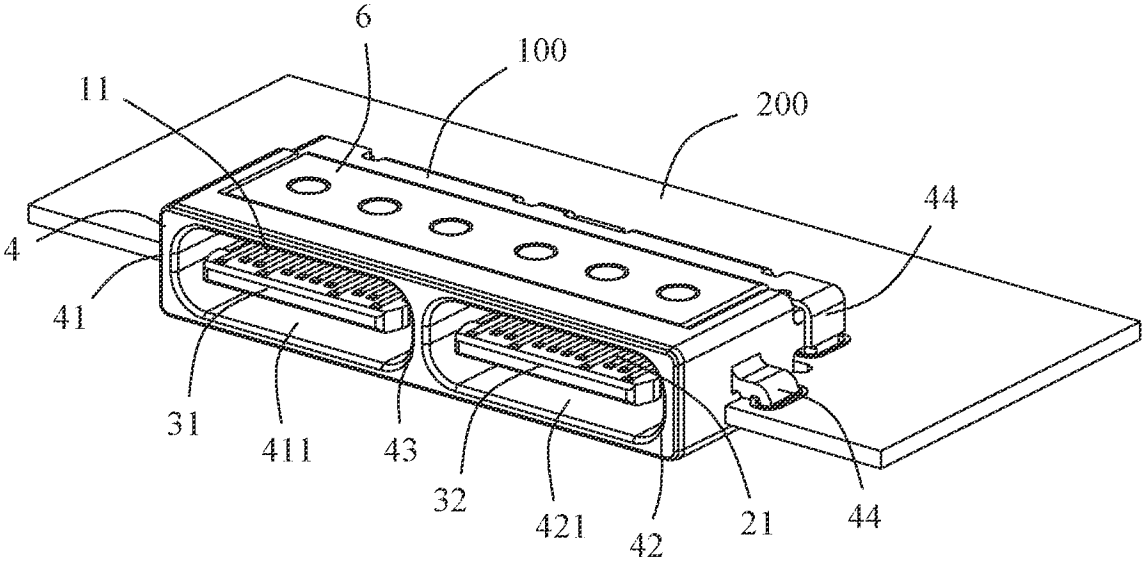
FIG. 1 illustrates a perspective view of an electrical connector mounted on a circuit board according to an exemplary embodiment of the instant disclosure.

Referring to FIGS. 1 to 9. The instant disclosure discloses an electrical connector 100 that can be mounted on a circuit board 200. The electrical connector 100 comprises a first conductive terminal module 1, a second conductive terminal module 2, an insulated body 3 integrally molded on the first conductive terminal module 1 and the second conductive terminal module 2, and a metallic shell 4 on the insulated body 3.

Referring to FIGS. 3 to 6. The insulated body 3 comprises a base portion 30, a first tongue portion 31 and a second tongue portion 32. The first tongue portion 31 and the second tongue portion 32 integrally extend forward from the base portion 30. The first tongue portion 31 and the second tongue portion 32 are aligned side by side and in the same height. In one embodiment, the first tongue portion 31 and the second tongue portion 32 are integrally formed with the base portion 30, so that positions of the first tongue portion 31 and the second tongue portion 32 can be ensured.

Figure 7:
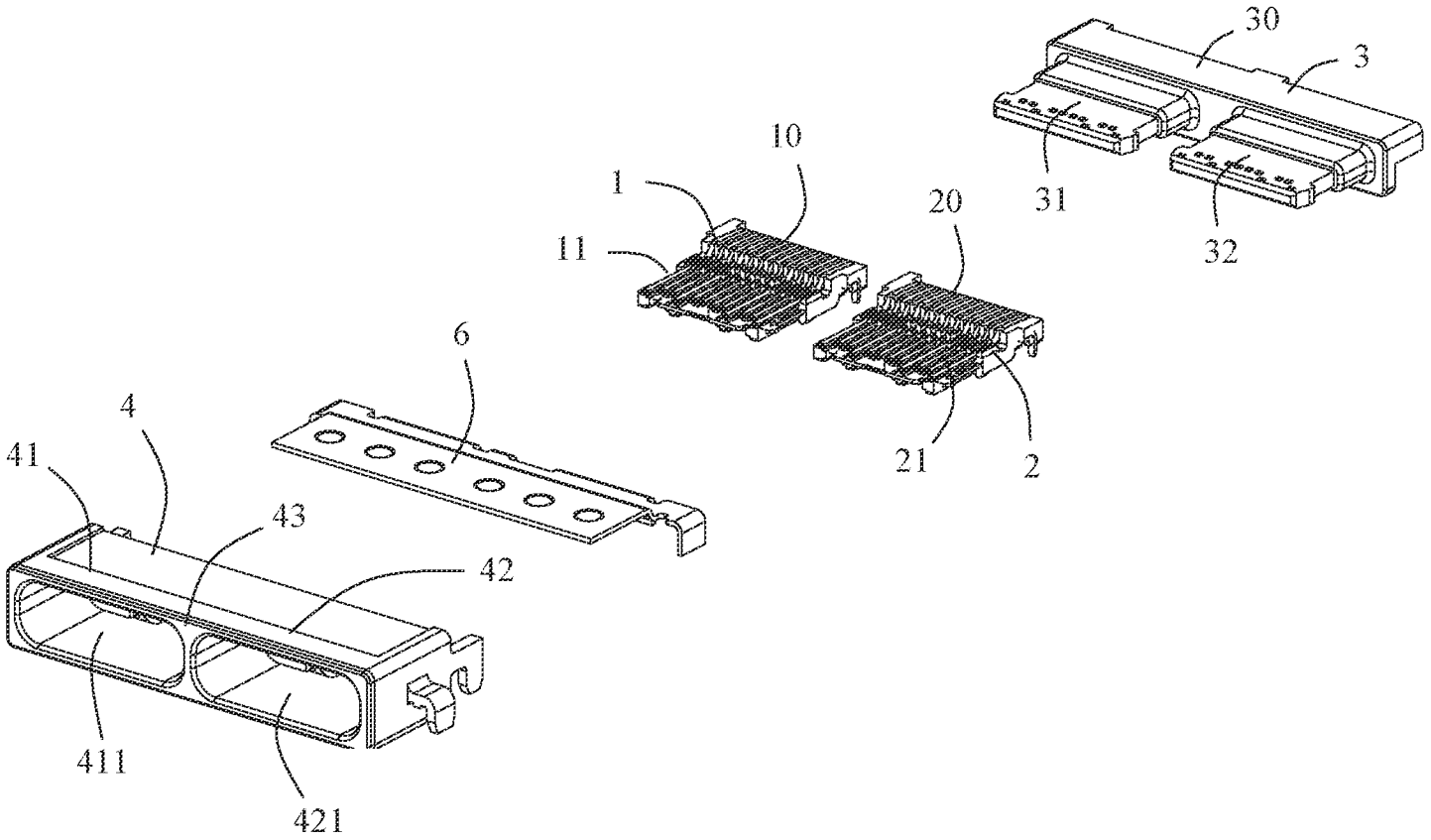
FIG. 7 illustrates a detailed partial exploded view of FIG. 6.
Figure 8:
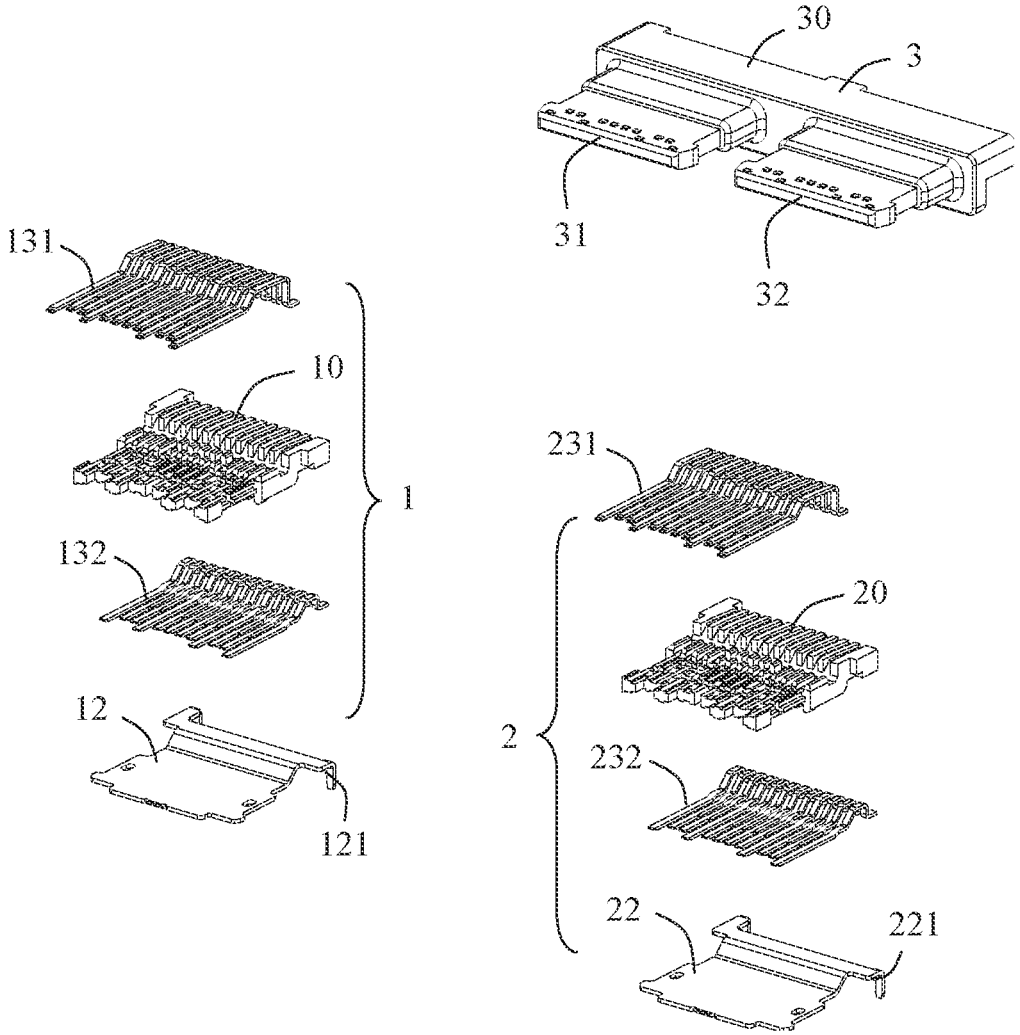
FIG. 8 illustrates an exploded view of the electrical connector of the first embodiment where the metallic shell and the metallic grounding sheet in FIG. 6 are omitted.
Figure 9:
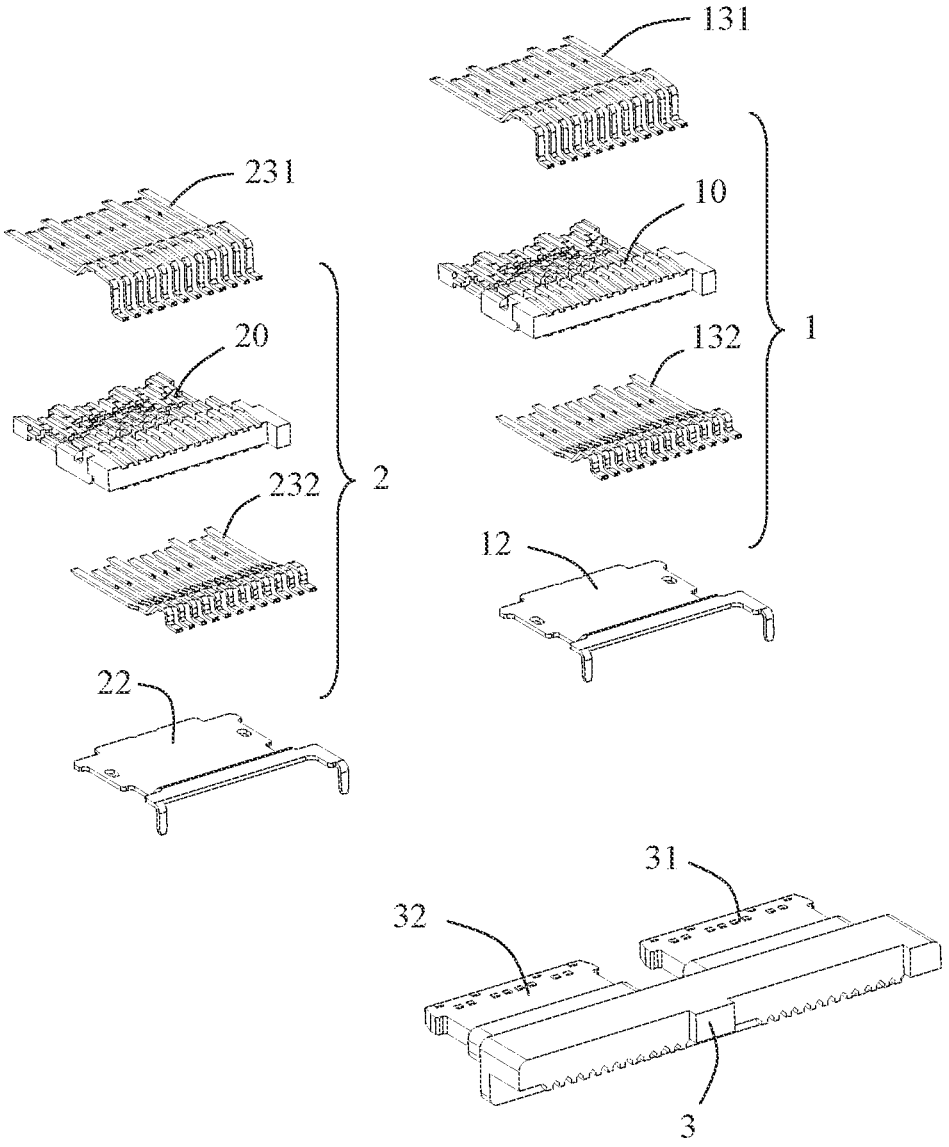
FIG. 9 illustrates another perspective view of FIG. 8.

Referring to FIGS. 7 to 9. The first conductive terminal module 1 comprises a first insulated block 10, a plurality of first conductive terminals 11 molded on the first insulated block 10 by insert-molding, and a first shielding sheet 12 molded in the first insulated block 10 by insert-molding. The plurality of first conductive terminals 11 is provided with a first contact portion 13 exposed on the first tongue portion 31 and a tail portion 14 for soldering on the circuit board 200. In this embodiment, the first contact portions 13 is plate-shaped and comprises a first upper-row contact portion 131 and a first lower-row contact portion 132. The first upper-row contact portion 131 is exposed from an upper surface of the first tongue portion 31, and the first lower-row contact portion 132 is exposed from a lower surface of the first tongue portion 31. The first shielding sheet 12 is located between the first upper-row contact portion 131 and the first lower-row contact portion 132 to avoid signal crosstalk. In one embodiment, the first shielding sheet 12 is provided with one or more mounting legs 121 for mounting on the circuit board 200, thereby having a better shielding effect.

Referring to FIGS. 7 to 9. The second conductive terminal module 2 comprises a second insulated block 20, a plurality of second conductive terminals 21 molded on the second insulated block 20 by insert-molding, and a second shielding sheet 22 molded in the second insulated block 20 by insert-molding. The plurality of second conductive terminals 21 is provided with a second contact portion 23 exposed on the second tongue portion 32 and a tail portion 24 for soldering on the circuit board 200. In this embodiment, the second contact portions 23 is plate-shaped and comprises a second upper-row contact portion 231 and a second lower-row contact portion 232. The second upper-row contact portion 231 is exposed from an upper surface of the second tongue portion 32, and the second lower-row contact portion 232 is exposed from a lower surface of the second tongue portion 32. The second shielding sheet 22 is located between the second upper-row contact portion 231 and the second lower-row contact portion 232 to avoid signal crosstalk. In one embodiment, the second shielding sheet 22 is provided with a plurality of mounting legs 221 for mounting on the circuit board 200, thereby having better shielding effect.

Figure 6:
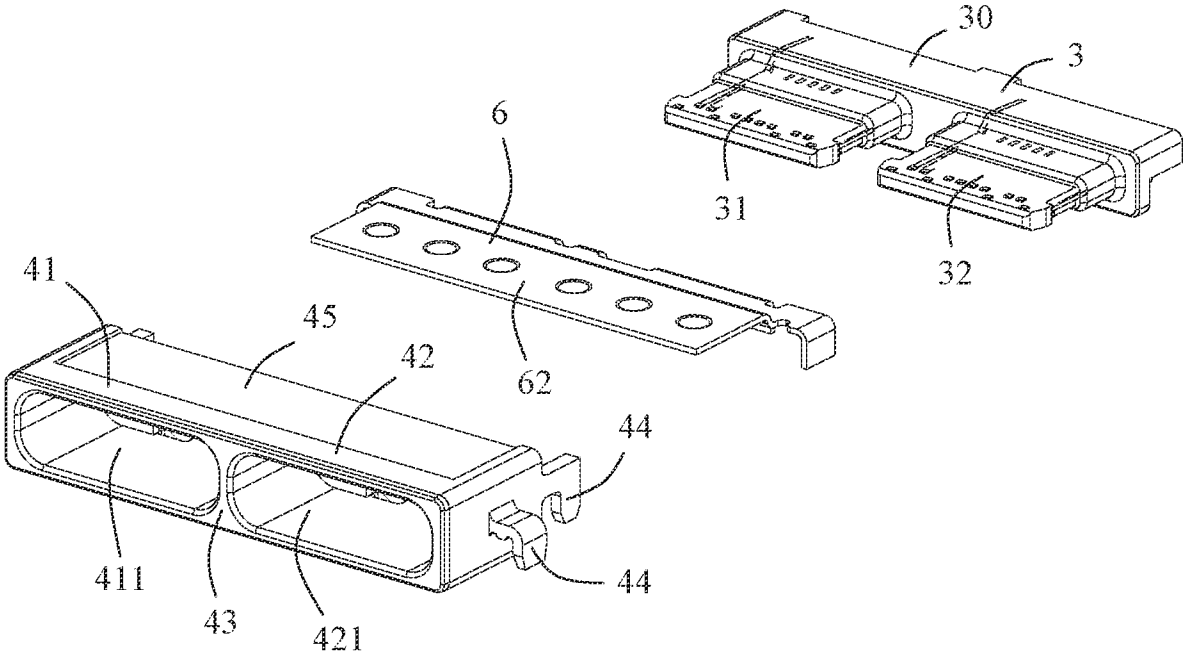
FIG. 6 illustrates a partial exploded view of the electrical connector of the exemplary embodiment.

Referring to FIGS. 6 and 7. In one embodiment, the insulated body 3 is molded on the first insulated block 10 and the second insulated block 20 by over-molding.

Referring to FIG. 6. The metallic shell 4 comprises a first cylinder portion 41 surrounding the first tongue portion 31, a second cylinder portion 42 surrounding the second tongue portion 32, and one or more grounding legs 44 for mounting on the circuit board 200. The first cylinder portion 41 is provided with a first space 411 for receiving a first mating electrical connector (e.g., a type-C electrical plug connector), the second cylinder portion 42 is provided with a second space 421 for receiving a second mating electrical connector (e.g., a type-C electrical plug connector), and the first cylinder portion 41 and the second cylinder portion 42 share a dividing portion 43 for separating the first space 411 from the second space 421.

Figure 3:
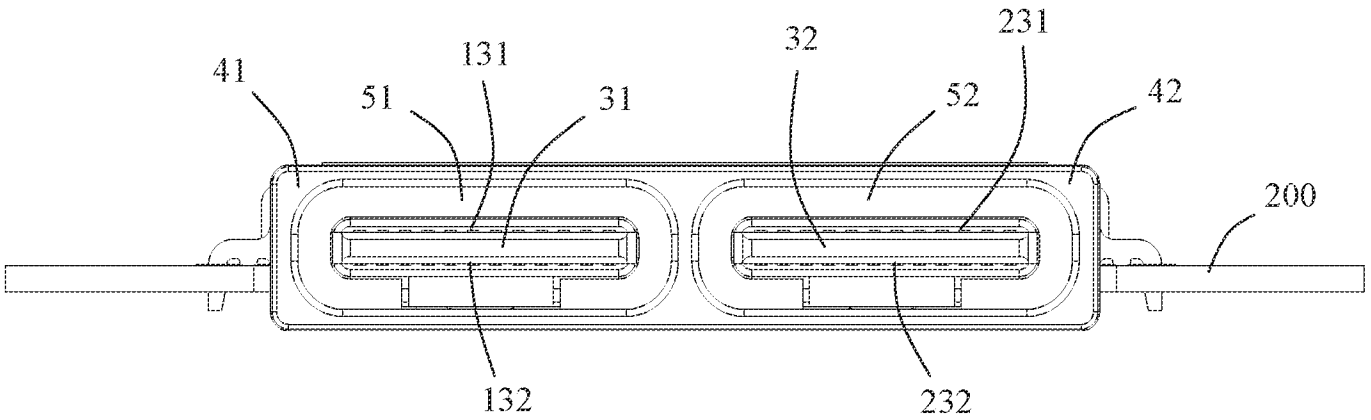
FIG. 3 illustrates a front plan view of FIG. 1.
Figure 4:
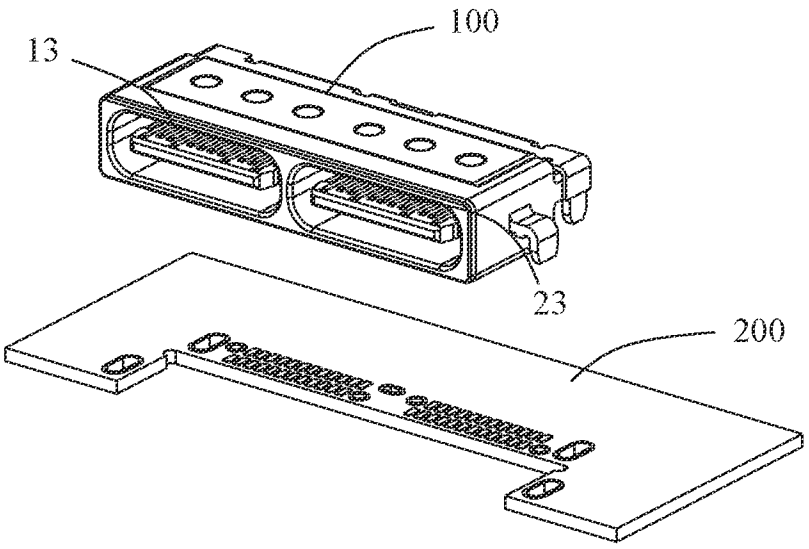
FIG. 4 illustrates a partial exploded view of FIG. 1.

In one embodiment, the first cylinder portion 41 and the second cylinder portion 42 are integrally formed as a one-piece member. The first cylinder portion 41, the first tongue portion 31, and the first conductive terminals 11 form a first electrical connection port 51. The second cylinder portion 42, the second tongue portion 32, and the second conductive terminals 21 form a second electrical connection port 52. The first electrical connection port 51 may be identical to or be different from the second electrical connection port 52. For example, the first electrical connection port 51 and the second electrical connection port 52 may have connector interfaces in the same specification or different specifications. In this embodiment, the first electrical connection port 51 is identical to the second electrical connection port 52 and both have a specification of a type-C electrical receptacle connector interface. Referring to FIG. 3. In this embodiment, the electrical connector 100 is a dip type electrical connector, and the first cylinder portion 41 and the second cylinder portion 42 are partially located above the circuit board 200 and partially located below the circuit board 200, thereby reducing the mounting height of the entire electrical connector 100.

Figure 2:
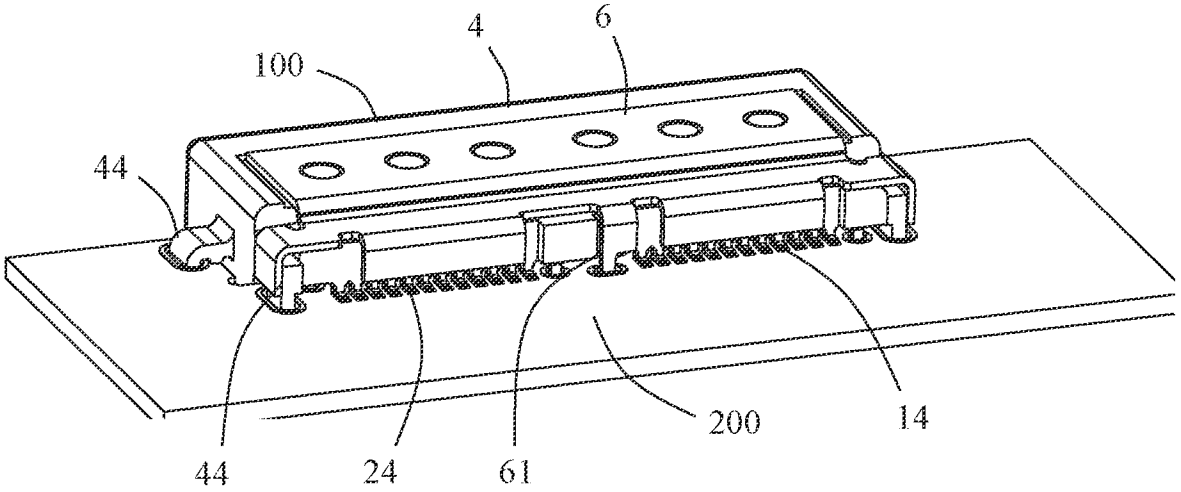
FIG. 2 illustrates another perspective view of FIG. 1.
Figure 5:
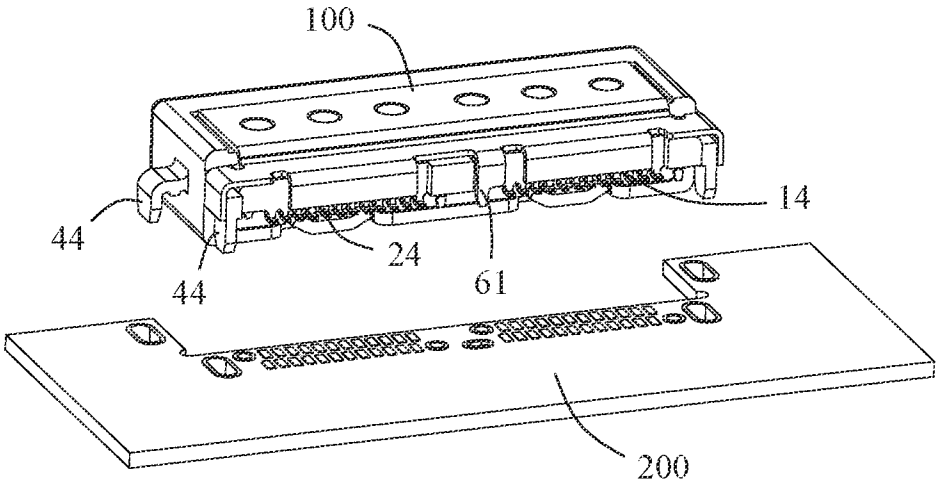
FIG. 5 illustrates a partial exploded view of FIG. 2.

Referring to FIGS. 2, 5, and 6. In this embodiment, the electrical connector 100 further comprises a metal grounding sheet 6 connected to the metallic shell 4. The metal grounding sheet 6 is provided with a grounding leg 61 for mounting on the circuit board 200. Specifically, in this embodiment, the metallic shell 4 comprises a concave portion 45, the metal grounding sheet 6 comprises a mounting portion 62 mounted in the concave portion 45, and the mounting portion 62 is fixed with the metallic shell 4 through spot welding. In this embodiment, the concave portion 45 is located on the upper surface of the metallic shell 4. In other embodiments, the metal grounding sheet 6 may be provided without the grounding leg 61, and the metal grounding sheet 6 can still achieve the grounding through the grounding legs 44 of the metallic shell 4.

Compared with the prior art, in one or some embodiments of the instant disclosure, by the configuration of the dividing portion 43 shared by the first cylinder portion 41 and the second cylinder portion 42, the first space 411 and the second space 421 are separated to form the first electrical connection port 51 and the second electrical connection port 52 independent to each other. Accordingly, when one of the electrical connection ports is mated with a mating electrical connector, the components in the other electrical connection port will not be damaged by improper or skew mating. Moreover, when a mismatched electrical connector is to be inserted into the connector, since the respective spaces of the first electrical connection port 51 and the second electrical connection port 52 are smaller, the probability of errored insertion can be reduced to a certain extent.

Embodiments mentioned above are only used for explaining the instant disclosure, but not a limitation to the instant disclosure. The understanding of the specification should be based on those skilled in the technical field, such as "front", "back", "left", "right", "up", "down", etc. may be used herein for directional descriptions. While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector, comprising:

a first conductive terminal;

a second conductive terminal;

an insulated body integrally molded on the first conductive terminal and the second conductive terminal;

a metallic shell on the insulated body; and a metal grounding sheet connected to the metallic shell;

wherein the insulated body comprises a first tongue portion and a second tongue portion aligned side by side with the first tongue portion, the first conductive terminal is provided with a first contact portion exposed on the first tongue portion, the second conductive terminal is provided with a second contact portion exposed on the second tongue portion; wherein the metallic shell comprises a first cylinder portion surrounding the first tongue portion and a second cylinder portion surrounding the second tongue portion, the first cylinder portion is provided with a first space for receiving a first mating electrical connector, the second cylinder portion is provided with a second space for receiving a second mating electrical connector, and the first cylinder portion and the second cylinder portion share a dividing portion for separating the first space from the second space; and wherein the metallic shell comprises a concave portion recessed from a surface of the metallic shell, the metal grounding sheet comprises a mounting portion mounted in the concave portion, and the mounting portion is fixed with the metallic shell through spot welding.

2. The electrical connector according to claim 1, wherein the first cylinder portion and the second cylinder portion are integrally formed as a one-piece member.

3. The electrical connector according to claim 1, wherein the first cylinder portion, the first tongue portion, and the first conductive terminal form a first electrical connection port; the second cylinder portion, the second tongue portion, and the second conductive terminal form a second electrical connection port; the first electrical connection port is identical to the second electrical connection port.

4. The electrical connector according to claim 3, wherein the first contact portion is plate-shaped and comprises a first upper-row contact portion and a first lower-row contact portion; the second contact portion is plate-shaped and comprises a second upper-row contact portion and a second lower-row contact portion; a height of the first tongue portion is the same as a height of the second tongue portion.

5. The electrical connector according to claim 4, wherein both the first electrical connection port and the second electrical connection port have a specification of a type-C electrical receptacle connector interface.

6. The electrical connector according to claim 4, wherein the insulated body comprises a base portion, the first tongue portion and the second tongue portion integrally extend from the base portion; the electrical connector further comprises a first insulated block integrally formed with the first conductive terminal and a second insulated block integrally formed with the second conductive terminal, and the insulated body is molded on the first insulated block and the second insulated block.

7. The electrical connector according to claim 6, further comprising a first shielding sheet fixed on the first insulated block and located between the first upper-row contact portion and the first lower-row contact portion and a second shielding sheet fixed on the second insulated block and located between the second upper-row contact portion and the second lower-row contact portion.

8. The electrical connector according to claim 7, wherein the first shielding sheet, the second shielding sheet, or each of the first shielding sheet and the second shielding sheet is provided with a mounting leg for mounting on a circuit board.

9. The electrical connector according to claim 1, wherein the first cylinder portion, the first tongue portion, and the first conductive terminal form a first electrical connection port; the second cylinder portion, the second tongue portion, and the second conductive terminal form a second electrical connection port; the first electrical connection port is different from the second electrical connection port.

10. The electrical connector according to claim 1, wherein the metal grounding sheet is provided with a grounding leg for mounting on a circuit board.

* * * * *